US006722345B2

(12) United States Patent
Saeki et al.

(10) Patent No.: US 6,722,345 B2
(45) Date of Patent: Apr. 20, 2004

(54) FUEL INJECTION SYSTEM FOR INTERNAL COMBUSTION ENGINE

(75) Inventors: Takayuki Saeki, Kariya (JP); Yoshimitsu Takashima, Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/310,856

(22) Filed: Dec. 6, 2002

(65) Prior Publication Data

US 2003/0106531 A1 Jun. 12, 2003

(30) Foreign Application Priority Data

Dec. 6, 2001 (JP) ..... 2001-372257
Feb. 5, 2002 (JP) ..... 2002-027657
Oct. 9, 2002 (JP) ..... 2002-296154

(51) Int. Cl.[7] ..... F02B 3/10
(52) U.S. Cl. ..... 123/435; 123/299; 123/447; 701/105
(58) Field of Search ..... 123/299, 435, 123/447; 701/105

(56) References Cited

U.S. PATENT DOCUMENTS 6,062,193 A * 5/2000 Gatellier ..... 123/299
6,378,487 B1 * 4/2002 Zukouski et al. ..... 123/435
6,390,058 B1 * 5/2002 Takahashi et al. ..... 123/299
6,561,157 B2 * 5/2003 zur Loye et al. ..... 123/435
6,609,493 B2 * 8/2003 Yamaguchi et al. ..... 123/299
6,659,068 B2 * 12/2003 Urushihara et al. ..... 123/435

FOREIGN PATENT DOCUMENTS

GB 2351816 1/2001
JP 2001-140689 5/2001

* cited by examiner

*Primary Examiner*—Erick Solis
(74) *Attorney, Agent, or Firm*—Nixon & Vanderhye P.C.

(57) ABSTRACT

A fuel injection system carries out a multi-injection. A preceding injection affects a pressure in a combustion chamber at a succeeding injection. In order to ensure an amount and timing of a succeeding injection, the ECU carries out a compensating process. In one embodiment, an injection period for the succeeding injection is corrected by varying a corrective value in accordance with parameters indicative of a pressure deviation. In another embodiment, each of the injection amounts for preceding and succeeding injections is corrected in accordance with deviations from a standard pressure respectively. The deviation is determined based on an intake pressure.

13 Claims, 10 Drawing Sheets

FIG. 6

| ACCP \ NE | LOW | MEDIUM | HIGH |
|---|---|---|---|
| LARGE | K=0. 8 | K=0. 8 | K=0. 8 |
| MEDIUM | K=1. 0 | K=1. 0 (REFERENCE) | K=1. 0 |
| SMALL | K=1. 2 | K=1. 2 | K=1. 2 |

FUEL INJECTION SYSTEM FOR INTERNAL COMBUSTION ENGINE

CROSS REFERENCE TO RELATED APPLICATION

This application is based on Japanese Patent Applications No. 2001-372257 filed on Dec. 6, 2001, No. 2002-27657 filed on Feb. 5, 2002 and No. 2002-296154 filed on Oct. 9, 2002 the contents of which are incorporated herein by reference.

BACKGROUND OF THE INVENTION

1. Field of the Invention

The present invention relates to a fuel injection system for an internal combustion engine. More in details, the invention relates to a fuel injection system for executing multi-injection including preceding injection and succeeding injection.

2. Description of Related Art

JP-2001-140689A discloses an accumulator fuel injection apparatus. According to an accumulator fuel injection apparatus, fuel is pressurized by a pump and pressurized fuel is accumulated in a common rail. High pressure fuel is distributed into a plurality of injectors from the common rail. The injector injects fuel into a combustion chamber. The accumulator fuel injection apparatus is referred to also as a common rail fuel injection apparatus.

In the case of accumulator fuel injection apparatus, a command injection amount (Q) is calculated by an engine revolution speed (NE) and an accelerator opening degree (ACCP), a command injection timing (T) is calculated by the engine revolution speed (NE) and the command injection amount (Q), electricity conducting time (command injection time: TQ) of an injector drive signal to the injector is calculated by fuel pressure (fuel pressure: Pc) in the common rail detected by a fuel pressure sensor and the command injection amount (Q), and a nozzle needle in the injector is opened by applying the injector drive signal in a pulse-like shape to an electromagnetic valve of the injector until finishing the command injection time (TQ) from the command injection timing (T) to thereby control the injection amount and the injection timing of fuel injected to supply from the injector into a respective cylinder of the engine.

Further, in order to deal with regulations of exhaust gas and noise in the accumulator fuel injection apparatus in recent years, specifically, with an object of reducing noise or vibration and promoting an exhaust gas performance of the engine by carrying out stable combustion from start of main injection, there is executed multi-injection (multi-injection) for carrying out small amounts of a plurality of times of preceding injection (pilot injection) before the main injection (main injection) which can constitute engine torque at a vicinity of top dead center. The multi-injection aims to restrain noise or vibration and promote the exhaust gas performance of the engine and the like in an injector of a specific cylinder of the engine by carrying out twice or more of multi-injection by opening the nozzle needle twice or more by driving the electromagnetic valve of the injector twice or more in the compression stroke and the expansion stroke of the engine (for example, once or more of pilot injection and main injection, or once or more of pre-injection and main injection, or pilot injection or pre-injection and main injection and after injection, or main injection and once or more of post-injection).

However, the injector mounted to the respective cylinder of the engine is constructed by a constitution in which by controlling back pressure of a command piston reciprocally moved in cooperation with the nozzle needle by opening and closing the electromagnetic valve, fuel pressure in a fuel storage provided at a surrounding of the nozzle needle, that is, fuel pressure operated in a direction of opening the nozzle needle overcomes urge force of a spring, etc. operated in a direction of closing the nozzle needle to thereby open the injector and therefore, after the elapse of predetermined injection delay time from starting electricity conduction to the electromagnetic valve of the injector, the nozzle needle is opened, further, after the elapse of predetermined injection finish delay time from finishing electricity conduction to the electromagnetic valve of the injector, the nozzle needle is closed.

Here, during the compression stroke of the engine, in carrying out multi-injection for carrying out once or more of small amounts of pre-injection or pilot injection prior to main injection by executing a plurality of times of electricity conduction to the electromagnetic valve of the injector, there poses a problem that by a change in the fuel pressure in the common rail which is brought about by pre-injection or pilot injection executed prior to main injection, the injection start delay time is shortened or prolonged to thereby bring about a variation in an injection amount relative to an aimed injection amount.

Hence, during the compression stroke of the engine, in executing multi-injection for carrying out once or more of small amounts of pre-injection or pilot injection prior to main injection by executing a plurality of times of electricity conduction to the electromagnetic valve of the injector, by inputting fuel pressure immediately before starting actual injection of preceding injection such as pre-injection or pilot injection and immediately before stating actual injection of succeeding injection such as main injection, injection time period of preceding injection and injection time period of succeeding injection are calculated. Or, as shown by a timing chart of FIG. 7, electricity conducting time of the injector drive signal for succeeding injection such as main injection executed after preceding injection such as pre-injection, that is, main injection time is calculated by adding an interval correction amount calculated by using a two-dimensional map of a non-injection interval between the pre-injection and the main injection (play interval) and fuel pressure in the common rail, to basic injection time calculated by a main injection amount (QM) which is set by the engine revolution speed and the command injection amount and the fuel pressure (Pc) in the common rail detected by a fuel pressure sensor.

However, there is a case in which depending on an engine operating condition or operating mode, an error between an actual main injection amount actually injected to supply into the cylinder of the engine and the aimed main injection amount (QM) is increased by only calculating the injection time period of preceding injection and the injection time period of succeeding injection by inputting fuel pressure immediately before starting actual injection of preceding injection such as pre-injection or pilot injection and immediately before starting actual injection of succeeding injection of main injection, further, adding the interval correction amount calculated by play interval and fuel pressure in the common rail during the basic injection time for main injection. As a result of intensive research on the cause, the applicant has found that the higher the combustion chamber pressure (pressure in cylinder) of the engine relative to standard combustion chamber pressure in a case in which preceding injection is not executed at a time point of starting actual injection of main injection, the larger the error between the actual main injection amount and the aimed main injection amount (QM) tends to increase.

According to the common rail fuel injection system, when fuel is injected, the injection amount of the injector is controlled by calculating from a characteristic map formed by calculating a relationship between the fuel injection amount and an injection time characteristic which is set in accordance with the engine operating condition previously by experiment and by outputting an injection command pulse to the injector.

Here, the characteristic map for calculating the fuel injection amount and the injection time characteristic is a map showing the relationship between the fuel injection amount and the injection time by assuming (predicting) fuel injection at predetermined angle at a vicinity of TDC of the engine. Further, although the injection time characteristic is influenced by combustion chamber pressure for injecting fuel and the common rail pressure, since a range used by single injection of the related art is disposed at a vicinity of TDC of the engine adapting the injection time characteristic to the fuel injection amount, the influence of the combustion chamber pressure can be disregarded.

However, in order to achieve a regulated value of exhaust gas of a vehicle mounted with a diesel engine in recent years, there has been developed an injection rate control called as multi-injection, in which fuel is injected in a plurality of times during one combustion cycle of the engine. When such multi-injection is carried out, fuel is injected in a plurality of times over a broad range before and after TDC of the engine and therefore, combustion chamber pressure at a vicinity of TDC of the engine in adapting the fuel injection amount and the injection time characteristic and combustion chamber pressure in starting fuel injection actually differ from each other. Further, the combustion chamber pressure of the engine generally becomes a low value before and after TDC of the engine with a vicinity of TDC of the engine as a top point. Thereby, the fuel injection amount and the injection time characteristic are changed by receiving a change in the combustion chamber pressure and there poses a problem that the actual fuel injection amount is dispersed relative to the respective fuel injection amount of multi-injection set in accordance with the engine operating condition and fuel with a correct value cannot be injected.

SUMMARY OF THE INVENTION

It is an object of the invention to provide a fuel injection system capable of restraining an error of a fuel injection timing or a fuel injection amount caused by a change in a combustion chamber pressure.

It is another object of the invention to provide a fuel injection system capable of realizing a target fuel injection amount in a succeeding injection.

It is further another object of the invention to provide a fuel injection system capable of realizing a target fuel injection timing in a respective fuel injection of multi-injection.

It is further another object of the invention to provide a fuel injection system capable of realizing a target fuel injection amount in a respective fuel injection of multi-injection.

According to the invention, by providing correction data storing means for storing correction data formed by calculating a relationship between a combustion chamber pressure of an internal combustion engine and an engine operating condition and an injection mode of a preceding injection influencing on an actual injection start timing of a succeeding injection carried out successively to the preceding injection carried out precedingly in carrying out a multi-injection for supplying to inject a fuel into a cylinder of the engine in a plurality of times by carrying out electricity conduction to an injector in a plurality of times during a compression stroke and an expansion stroke of the engine previously by an experiment, an electricity conduction time period of an injector drive signal for the succeeding injection can be corrected based on the correction data stored by the correction data storing means. Thereby, by reflecting the influence of the combustion chamber pressure of the engine brought about by the preceding injection carried out precedingly prior to the succeeding injection in a correction amount of an electricity conduction time period of an injector drive signal for the succeeding injection, an accuracy of injection amounts at a second stage and thereafter in carrying out the multi-injection can be promoted.

According to the invention, the correction data storing means is characterized in storing the correction data formed by calculating a relationship of the actual injection start timing of the succeeding injection carried out successively to the preceding injection carried out precedingly with any one or more of the combustion chamber pressure of the engine, an engine load or an engine revolution speed or a fuel pressure or a command injection amount and any one or more of an injection amount of the preceding injection or an injection time period of the preceding injection or a noninjection interval between the preceding injection and the succeeding injection or an injection start timing of the succeeding injection previously by an experiment.

According to the invention, by providing combustion chamber pressure predicting means for predicting the combustion chamber pressure of the engine by the engine operating condition of the engine and the injection mode of the preceding injection influencing on the actual injection start timing of the succeeding injection carried out successively to the preceding injection carried out precedingly in carrying out the multi-injection for supplying to inject the fuel into the cylinder of the engine in a plurality of times by carrying out electricity conduction to the injector during the compression stroke and during the expansion stroke of the engine in a plurality of times, the electricity conduction time period of the injector drive signal for the succeeding injection can be corrected based on the combustion chamber pressure predicted by the combustion chamber pressure predicting means. Thereby, by reflecting the influence of the inner cylinder pressure brought about by the preceding injection carried out precedingly prior to the succeeding injection in the correction amount of the electricity conduction time period of the injector drive signal for the succeeding injection, the accuracy of the injection amounts at the second stage and thereafter in carrying out the multi-injection can be promoted.

According to the invention, by providing combustion chamber pressure detecting means for detecting the combustion chamber pressure influencing on the actual injection start timing of the succeeding injection carried out successively to the preceding injection carried out precedingly in carrying out the multi-injection for supplying to inject the fuel into the cylinder of the engine in a plurality of times by carrying out electricity conduction to the injector in a plurality of times during the compression stroke and the expansion stroke of the engine, the electricity conduction time period of the injector drive signal for the succeeding injection can be corrected based on the combustion chamber pressure of the engine detected by the combustion chamber pressure detecting means. Thereby, by reflecting the influence of the combustion chamber pressure brought about by the preceding injection carried out precedingly prior to the succeeding injection in the correction amount of the electricity conduction time period of the injector drive signal for the succeeding injection, the accuracy of the injection amounts at the second stage and thereafter in carrying out the multi-injection can be promoted.

According to the invention, in carrying out the multi-injection for carrying out a small amount of a pilot injection or a pre-injection before carrying out a main injection which can constitute an engine torque at, for example, a vicinity of a top dead center, the inner cylinder pressure at the actual injection start timing of the main injection as the succeeding injection tends to increase more than the combustion chamber pressure of a standard engine when the engine is not influenced by the preceding injection. Hence, by setting the electricity conduction time period of the injector drive signal for the succeeding injection to be shorter in accordance with a degree of increasing the combustion chamber pressure influencing on the actual injection start timing of the succeeding injection than the combustion chamber pressure of the standard engine when the combustion chamber pressure is not influenced by the preceding injection, a variation in the injection amount relative to an aimed injection amount can be restrained.

According to the invention, by applying the injector drive signal to needle driving means, high pressure fuel supplied into a pressure control chamber is overflowed to a low pressure side of a fuel system. Thereby, a nozzle needle overcomes urge force of needle urging means to thereby open the nozzle needle. Further, according to the invention, the invention is characterized in that the succeeding injection is the main injection which can constitute the engine torque at a vicinity of the top dead center and the preceding injection is a small amount of the pilot injection or the pre-injection carried out before carrying out the main injection. Further, according to the invention, the invention is characterized in that the preceding injection is the main injection which can constitute the engine torque at a vicinity of the top dead center and the succeeding injection is a very small amount of an after injection or a post-injection carried out after carrying out the main injection.

According to the invention, a basic injection time period of a respective fuel injection of the multi-injection is calculated by a map or an equation showing a relationship between a fuel injection amount and an injection time period set by assuming (predicting) fuel injection at a predetermined angle at a vicinity of the top dead center of the engine. Further, an injection start angle in starting the respective fuel injection of the multi-injection is calculated from the injection timing and the above-described basic injection time period set in accordance with the engine operating condition. Further, the combustion chamber pressure in starting the respective fuel injection of the multi-injection is calculated by a map or an equation showing a relationship between the injection start angle and the combustion chamber pressure.

Further, by correcting the basic injection time period of the respective fuel injection of the multi-injection in accordance with an amount of a change in the combustion chamber pressure between the combustion chamber pressure calculated based on the injection start angle and the assumed combustion chamber pressure assumed in calculating the basic injection time period, in the respective fuel injection of the multi-injection for injecting the fuel in a broad range before and after the top dead center of the engine, the respective fuel injection amount of the multi-injection set in accordance with the engine operating condition can correctly be injected. Further, in injection time period determining means, the basic injection time period of the respective fuel injection of the multi-injection may be calculated by adding fuel pressure detected by fuel pressure detecting means.

According to the invention, by calculating a correction amount of the injection amount by taking into consideration, the amount of the change in the combustion chamber pressure in starting the respective fuel injection of the multi-injection between the combustion chamber calculated based on the injection start angle and the assumed combustion chamber pressure assumed in calculating the basic injection time period by adding suction pressure detected by suction pressure detecting means to the calculated value of the combustion chamber pressure in starting the respective fuel injection of the multi-injection, in the case of carrying out the multi-injection for injecting fuel in a broad range before and after the top dead center of the engine, a dispersion between the command injection amount set in accordance with the engine operating condition and a total injection amount produced by adding the respective fuel injection amounts of the multi-injection can be restrained.

According to the invention, a fuel pressure correction coefficient is calculated from fuel pressure immediately before the respective fuel injection of the multi-injection. Further, the invention is characterized in that the injection amount corrected by the inner cylinder pressure of the respective fuel injection of the multi-injection is constituted by a value produced by multiplying the correction amount of the injection amount by the calculated fuel pressure correction coefficient. Thereby, the effect of the invention can further be promoted.

According to the invention, the effect of the invention can further be promoted by calculating a final correction injection amount of the respective fuel injection of the multi-injection by adding the injection amount corrected by the combustion chamber pressure to the respective fuel injection amount of the multi-injection set by the injection amount controlling means. Further, according to the invention, the effect of the invention can further be promoted by calculating a final injection time period of the respective fuel injection of the multi-injection by adding the fuel pressure immediately before the respective fuel injection of the multi-injection and the injection amount corrected by the combustion chamber pressure to the basic injection time period of the respective fuel injection of the multi-injection set by injection time period determining means.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

FIG. 6 is a map showing a relationship among the engine revolution number NE, an accelerator opening degree ACCP and a correction amount K according to the first embodiment of the invention;

DETAILED DESCRIPTION OF THE PREFERRED EMBODIMENTS

First Embodiment

Figure 1:
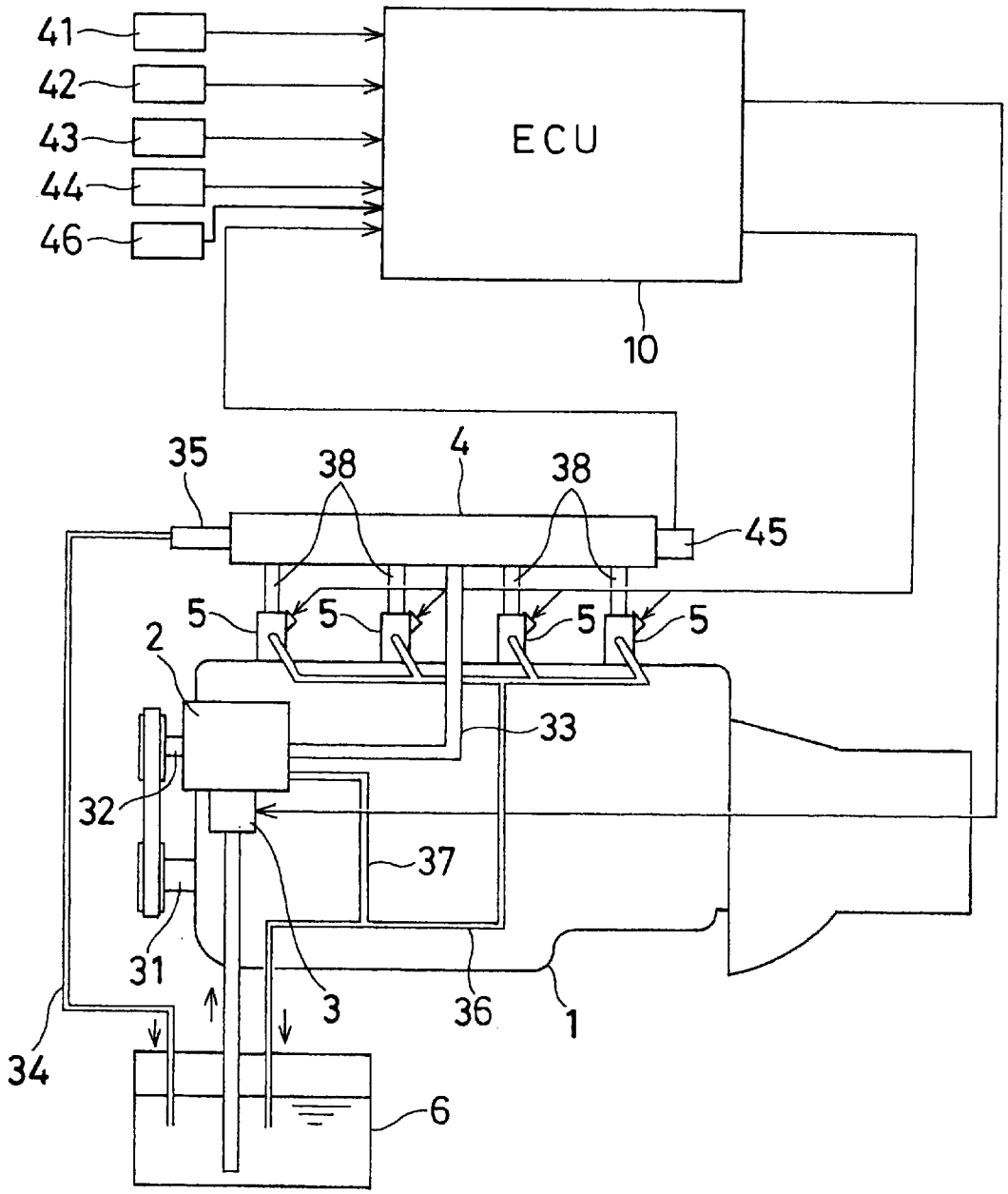
FIG. 1 is a block diagram showing an engine and an engine control system according to a first embodiment of the invention.

A common rail fuel injection system according to the embodiment is provided with a constitution illustrated in FIG. 1. The constitution is provided with a supply pump 2 driven to rotate by an internal combustion engine (hereinafter, referred to as engine) 1 of a multi-cylinder diesel engine or the like, a common rail (accumulator pipe) 4 forming an accumulating chamber for accumulating high pressure fuel delivered from the supply pump 2, a plurality of pieces (four pieces in the example) of injectors 5 each having a two way valve type electromagnetic valve for supplying to inject high pressure fuel accumulated in the common rail 4 into combustion chambers of respective cylinders of the engine 1, and an electronic control unit (corresponding to an injection amount control apparatus: hereinafter, referred to as ECU) 10 for electronically controlling the supply pump 2 and the plurality of pieces of injectors 5.

The supply pump 2 includes a feed pump (low-pressure pump) for scooping up fuel in a fuel tank 6 by rotating a pump drive shaft 32 in accordance with rotation of a crankshaft 31 of the engine 1, a plunger driven by the pump drive shaft 32 and a pressurizing chamber (plunger chamber) for pressurizing fuel by reciprocal movement of the plunger. A high-pressure pump is constituted by the plunger and the pressurizing chamber. Further, the supply pump 2 pressurizes fuel sucked out by the feed pump to constitute high pressure and supplies fuel to the common rail 4 via a fuel pipe 33. Further, a revolution speed sensor 41 and a fuel temperature sensor 44, mentioned later, are installed in the supply pump 2. Further, a fuel path of the supply pump 2 to the pressurizing chamber is attached with a suction control valve 3 for opening and closing the fuel path as an electromagnetic type actuator.

The suction control valve 3 is electronically controlled by a control signal (pump drive signal) from ECU 10 via a pump drive circuit, not illustrated. The suction control valve 3 is a suction amount controlling electromagnetic valve for controlling a suction amount of fuel sucked into the pressurizing chamber of the supply pump 2. The suction control valve 3 changes pressure of fuel injected and supplied from the respective injector 5 to the engine 1, that is, common rail pressure. The suction control valve 3 is a normally open type pump flow rate control valve a valve state of which is brought into a fully open state when electricity conduction is stopped.

It is necessary for the common rail 4 to continuously accumulate high pressure corresponding to fuel pressure and for that purpose, the common rail 4 is connected to a delivery port of the supply pump 2 via the fuel pipe 33. Further, a pressure limiter 35 as a pressure safety valve for restraining fuel pressure to be equal to or lower than limit set pressure which is opened when fuel pressure in the system exceeds limit set pressure is arranged between the common rail 4 and a relief pipe (low-pressure pipe) 34. Further, leaked fuel from the injector 5 and leaked fuel from the supply pump 2 are returned to the fuel tank 6 via leak pipes (low-pressure pipes) 36 and 37.

The injectors 5 mounted to the respective cylinders of the engine 1 are connected to downstream ends of a plurality of branch pipes (high-pressure pipes) 38 diverged from the common rail 4 and each of the injectors 5 is constituted by a fuel injection nozzle 11 for supplying high pressure fuel to inject into a combustion chamber of the respective cylinder of the engine 1 and a two way valve type electromagnetic valve (hereinafter, abbreviated as electromagnetic valve) 12 as an electromagnetic type actuator for driving the fuel injection nozzle 11. The fuel injection nozzle 11 is constituted by a nozzle needle 13 for opening and closing a plurality of pieces of injection holes 16, urging means (not illustrated) of a spring or the like for urging the nozzle needle 13 in a closing direction, a command piston 14 operated in cooperation with the nozzle needle 13 and a nozzle main body 15 for containing these.

Here, numeral 17 designates a fuel storage always supplied with high pressure fuel, numeral 18 designates a fuel path for supplying high pressure fuel to the fuel storage 17 and a pressure control chamber 19 and numerals 20 and 21 designate orifices for controlling a flow rate of fuel passing therethrough. The electromagnetic valve 12 is constituted by an electromagnetic solenoid 24 electrically connected to a vehicle-mounted power source 22 via a normally open type switch 23 included in an injector drive circuit, a valve body 25 having an armature drawn in an upward direction of the drawing by magnetomotive force of the electromagnetic solenoid 24 and a return spring 26 for urging the valve body 25 in a closing direction.

Further, injection of fuel from the injector 5 of the respective cylinder to the engine 1 is electronically controlled by an electromagnetic valve control signal to the injector drive circuit for driving the electromagnetic valve 12. Further, during a time period in which the electromagnetic valve 12 is being opened by applying an injector drive signal (hereinafter, referred to as injector injection pulse) from the injector drive circuit to the electromagnetic solenoid 24 of the electromagnetic valve 12 of the injector 5 for the respective cylinder, by lifting the nozzle needle 13 from a valve seat, the injection hole 16 and the fuel storage 17 are communicated with each other. Thereby, high pressure fuel accumulated in the common rail 4 is supplied to inject into the combustion chamber of the respective cylinder of the engine 1.

ECU 10 is provided with a microcomputer having a well-known structure constituted by including functions of CPU for executing control processings and operation processings, memories (ROM, RAM) for holding various programs and data, an input circuit, an output circuit, a power source circuit, the injector drive circuit and the pump drive circuit, etc. Further, ECU 10 is constituted to supply ECU power source and electronically controls, for example, the suction control valve 3 of the supply pump 2 and the electromagnetic valve 12 of the injector 5 based on control programs stored in the memories when an ignition switch is made ON. Further, ECU 10 is constituted to forcibly finishes the above-described control based on control programs stored in the memories when the ignition switch is made OFF and supply of ECU power source is cut.

Here, sensor signals from various sensors are constituted to be subjected to A/D conversion by an A/D converter and thereafter inputted to the microcomputer included in ECU 10. Further, the microcomputer includes a plurality of sensors as operating state detecting means for detecting an operating state of the engine 1. The system includes the revolution speed sensor 41 for detecting engine revolution speed NE. The system includes an accelerator opening sensor 42 for detecting an accelerator opening degree ACCP. The system includes a cooling water temperature sensor 43 for detecting engine cooling water temperature THW. The system includes the fuel temperature sensor 44 for detecting temperature of fuel on a pump suction side sucked into the supply pump 2. The system includes a fuel pressure sensor 45 for detecting fuel pressure in the common rail 4. The system includes a suction pressure sensor 46 for detecting suction pipe pressure PIN of the engine 1.

Further, ECU 10 includes fuel pressure controlling means. That is, ECU 10 calculates target common rail pressure Pt from an engine operating condition of the engine revolution number NE or the like. In order to achieve the target common rail pressure Pt, ECU 10 controls a delivery amount of fuel delivered from the supply pump 2 by controlling a pump drive signal to the suction control valve 3 of the supply pump 2.

Further, more preferably, with a purpose of promoting accuracy of the injection amount from the injector 5 of the respective cylinder, it is preferable to control the pump drive signal (drive current value) to the suction control valve 3 of the supply pump 2 by a feedback control so that common rail pressure Pc detected by the fuel pressure sensor 45 may substantially coincides with the target common rail pressure Pt. Further, it is preferable to control the drive current value for the suction control valve 3 by a duty control. For example, a highly accurate digital control can be carried out by using the duty control for changing a valve opening degree of the suction control valve 3 by controlling a rate of ON/OFF of the pump drive signal per unit time (duty ratio) in accordance with a pressure deviation AP between the common rail pressure Pc and the target common rail pressure Pt.

Further, ECU 10 is provided with injection amount or injection timing determining means (injection or injection timing detecting means) for calculating a command injection amount Q (target injection amount) or command injection timing T based on the engine operating condition of the revolution number NE and the accelerator opening degree ACCP, etc., injection number of times determining means for calculating a necessary number of times of injections in accordance with the operating condition of the engine 1 and the command injection amount Q, injection time period determining means (injection time period detecting means) for calculating electricity conduction time TQ for the electromagnetic valve 12 of the injector 5 based on the common rail pressure Pc detected by the fuel pressure sensor 45 and the target injection amount Q, and injector driving means for outputting an injector drive signal in a pulse-like shape until finishing desired injection time period TQ from the command injection timing T.

Among the above-described sensors, the revolution speed sensor 41 is provided to be opposed to an outer periphery of a timing rotor attached to the crankshaft 31 of the engine 1 or the pump drive shaft 32 of the supply pump 2. An outer peripheral face of the timing rotor is arranged with a plurality of pieces of projected teeth at every predetermined angle and is provided with four pieces of toothless portions for determining reference positions (top dead center positions: TDC positions) of respective cylinders for constituting references to correspond to the respective cylinders of the engine 1 at every predetermined angle (180° CA).

Figure 7:
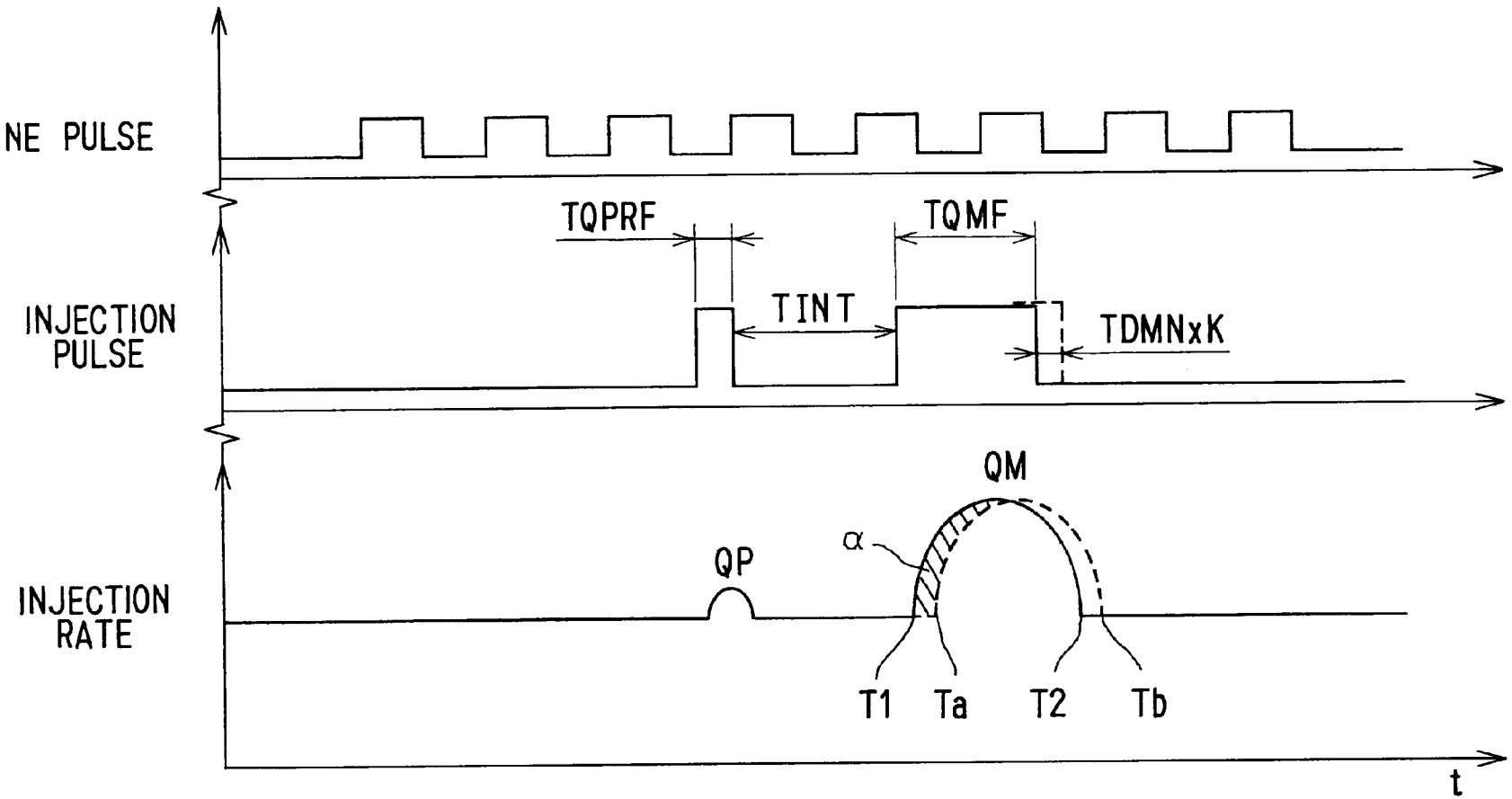
FIG. 7 is a time chart showing fuel injection according to the first embodiment of the invention.

Further, the revolution speed sensor 41 comprises an electromagnetic pickup and outputs a rotational position signal in a pulse-like shape (NE pulse) illustrated in FIG. 7. Further, ECU 10 is operated as revolution speed detecting means for detecting the engine revolution number NE by measuring interval time of NE pulse. Further, the accelerator opening degree sensor 42 is operated as engine load detecting means for detecting engine load of the accelerator opening degree ACCP or the like.

Here, according to the common rail fuel injection system of the embodiment, there is carried out multi-injection for injecting fuel in a plurality of times during one period (suction stroke-compression stroke-expansion stroke (explosion stroke)-exhaust stroke) of the engine 1, that is, during a time period in which the crankshaft 31 of the engine 1 makes two revolutions (720°) in the injector 5 of a specific cylinder of the engine 1.

According to the embodiment, during the compression stroke and during the expansion stroke of the engine 1, electricity is conducted to the electromagnetic valve 12 of the injector 5 by a plurality of times. In multi-injection, at a vicinity of a top dead center, prior to main injection which can constitute engine torque, once or more of pre-injection is carried out. Or, once or more of post-injection may be also carried out after main injection. Further, pre-injection, main injection and post-injection may be carried out in this order. Pre-injection is referred to also as pilot injection. Post-injection is referred to also as after injection.

Further, an injection mode of preceding injection and an injection mode of succeeding injection shown in the timing chart of FIG. 7 shows a case of multi-injection for executing a small amount of pre-injection prior to main injection which can constitute engine torque at a vicinity of the top dead center. Notation TINT in the timing chart of FIG. 7 designates an interval between pre-injection (preceding injection) and main injection (succeeding injection). Notation TQPRF designates final pre-injection time (pre-injection pulse width) of pre-injection. Notation TQMF designates final main injection time period (main injection pulse width) of main injection. Notation TDMN designates an interval correction amount as an injection time period correction amount.

As operating condition detecting means for detecting an operating condition of the engine 1, injection amount detecting means for detecting (calculating) the command injection amount Q or injection timing detecting means for detecting (calculating) the command injection timing T may be adopted. Further, as injection mode detecting means for detecting an injection mode of pre-injection or main injection, interval detecting means for detecting (calculating) the interval TINT between pre-injection and main injection, or pre-injection amount detecting means for detecting (calculating) the pre-injection amount QP or injection balance center position detecting means for detecting an injection balance center of pre-injection (pre-injection start timing, pre-injection finish timing) may be adopted.

(Processing Method of Embodiment)

Next, a method of processing a pre-injection amount and a main injection amount of the injector 5 mounted to a specific cylinder of the engine 1 will be explained in reference to FIG. 1 through FIG. 6.

Figure 3:
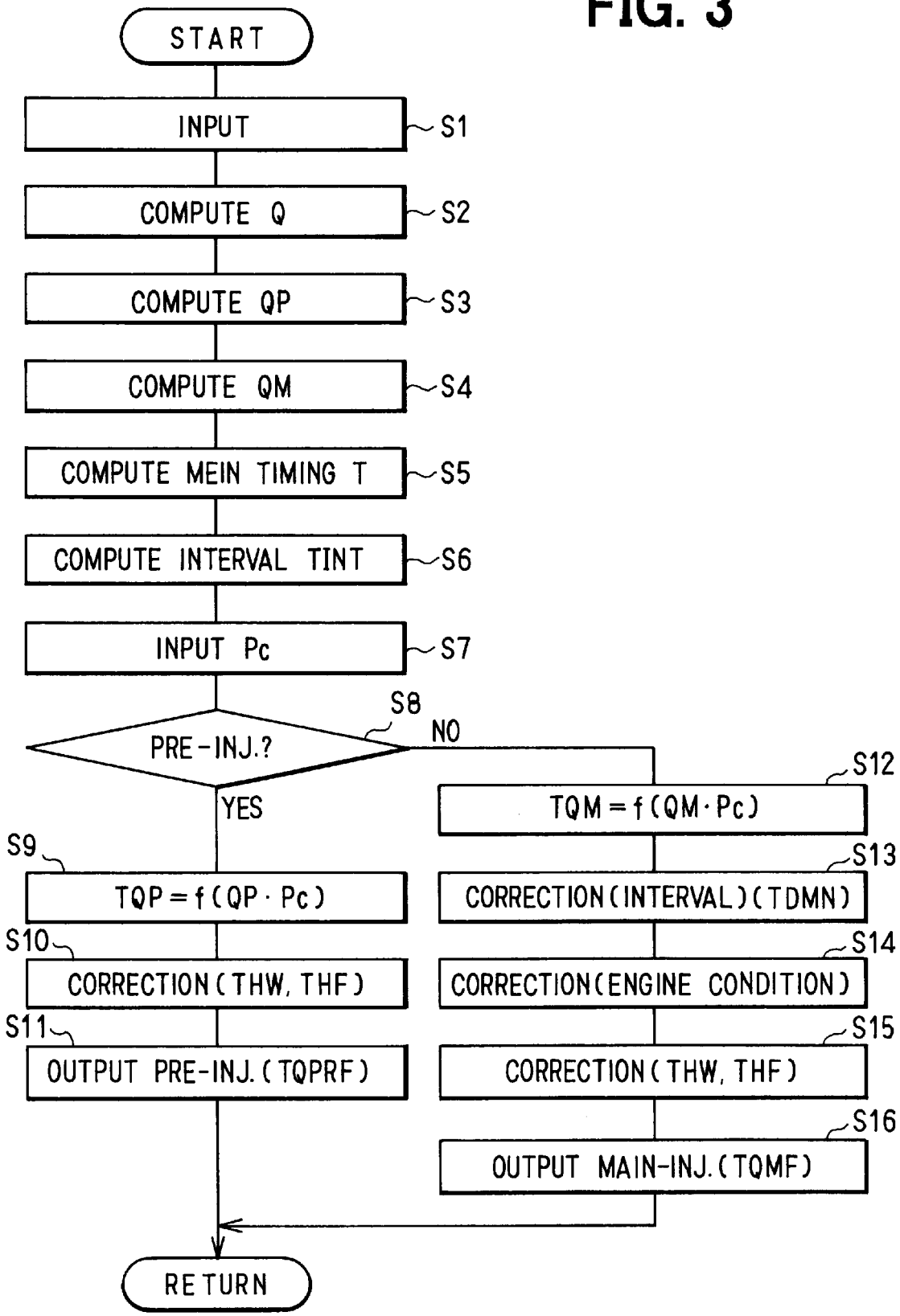
FIG. 3 is a flowchart showing a fuel injection control according to the first embodiment of the invention.
Figure 4:
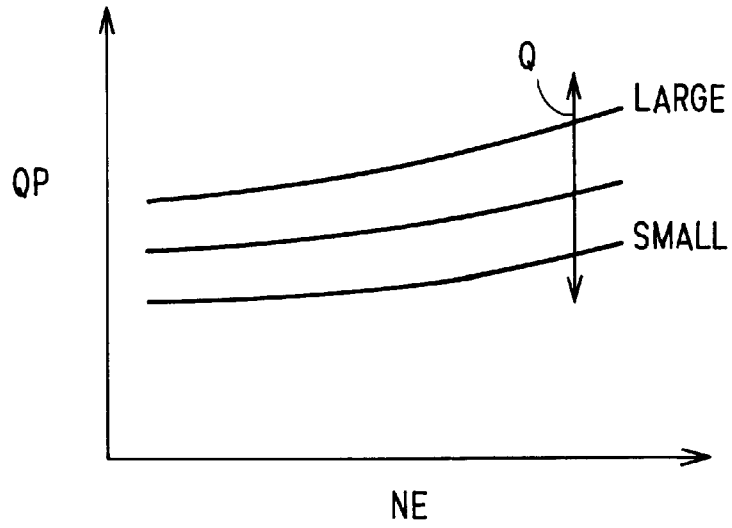
FIG. 4 is a graph showing a relationship among an engine revolution number NE, a target injection amount Q and a pre-injection amount QP according to the first embodiment of the invention.
Figure 5:
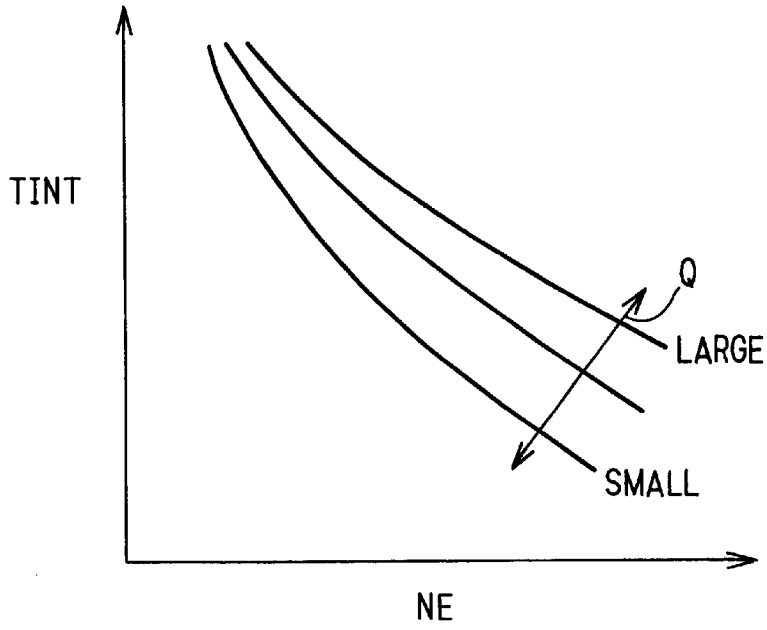
FIG. 5 is a graph showing a relationship among the engine revolution number NE, the target injection amount Q and an interval TINT according to the first embodiment of the invention.

The processing of FIG. 3 is repeated at every predetermined timing after the ignition switch is made ON. For example, a processing of a pre-injection amount and a main injection amount of the injector 5 (injection rate control of injector 5) of k cylinder may be started after finishing injection of the injector 5 of k cylinder at a preceding cycle. Further, at a current cycle, the processing may be started immediately after finishing injection of a cylinder immediately before k cylinder (second cylinder when k cylinder is first cylinder, first cylinder when k cylinder is third cylinder, third cylinder when k cylinder is fourth cylinder, fourth cylinder when k cylinder is second cylinder).

First, the engine parameters such as the engine revolution number NE, the accelerator opening degree ACCP, the engine cooling water temperature THW and the fuel temperature THF are inputted (step S1). Next, the target injection amount Q is calculated on the basis of the engine parameters. Specifically, the target injection amount Q is calculated based on a characteristic map or a calculating equation formed by measuring a relationship among the engine revolution number NE, the accelerator opening degree ACCP and the target injection amount Q previously by experiment (step S2).

Next, the pre-injection amount QP is calculated based on a characteristic map or a calculating equation formed by measuring a relationship among the target injection amount Q, the engine revolution number NE and the pre-injection amount QP previously by experiment (step S3). The pre-injection amount QP is calculated as a value in accordance with the target injection amount Q and the engine revolution number NE based on the map shown in FIG. 4. Next, the main injection amount QM is calculated by subtracting the pre-injection amount QP from the target injection amount Q (step S4).

Next, the command injection timing T is calculated in accordance with the engine parameters. Specifically, the command injection timing T corresponding to main injection start timing is calculated based on a characteristic map or a calculating equation formed by measuring a relationship among the target injection amount Q, the engine revolution number NE and the command injection timing T previously by experiment (step S5). Next, the interval TINT is calculated based on a characteristic map or a calculating equation formed by measuring a relationship among the target injection amount Q, the engine revolution number NE and the interval TINT between pre-injection and main injection previously by experiment (step S6). The interval TINT is calculated based on a map shown in FIG. 5.

Next, the common rail pressure Pc detected by the fuel pressure sensor 45 is inputted (step S7). Next, whether timing of calculating pre-injection time is constituted is determined (step S8). When a determination result of step S8 is YES, the basic injection time period TQP of pre-injection is calculated based on a characteristic map or a calculating equation formed by measuring a relationship among the pre-injection amount QP, the common rail pressure Pc and the basic injection time period TQP of pre-injection previously by experiment (step S9). Further, as the common rail pressure Pc for calculating the basic injection time period TQP of pre-injection, the common rail pressure Pc immediately before pre-injection may be detected and used for calculation processing.

Next, a pre-injection command value TQPRF is calculated by adding a correction item in consideration of the engine cooling water temperature THW and the fuel temperature THF to the basic injection time TQP of pre-injection set by the processing at step S9. The pre-injection command value is an injection pulse width (injection pulse time) of pre-injection applied to the electromagnetic valve 12 of the injector 5 (step S10).

Next, the pre-injection start timing TP is calculated by adding the interval TINT set by the processing at step S6 and the injection pulse width TQPRF to the command injection timing T set by the processing at step S5. Further, the pre-injection start timing TP and the pre-injection command value TQPRF set by the processing at step S10 are set to an output stage of ECU 10 (step S11). Thereafter, the operation returns to initial step S1 and repeats the above-described respective processings.

Further, when the determination result at S8 is NO, the basic injection timing TQM of main injection is calculated based on a characteristic map or a calculating equation formed by measuring a relationship among the main injection amount QM, the common rail pressure Pc and the basic injection time period TQM of main injection previously by experiment (step S12). Further, as the common rail pressure Pc for calculating the basic injection time TQM of main injection, the common rail pressure Pc immediately before main injection may be calculated and used for calculation processing.

Next, at step S13, an interval correction amount TDMN is calculated based on a characteristic map that is defined by the interval TINT calculated in the step S6 and the common rail pressure Pc detected by the fuel pressure sensor 45. The characteristic map for calculating TDMN is a two-dimensional map defined with parameters, the common rail pressure Pc and the interval TINT, and obtains the interval correction amount TDMN as adapted value. The characteristic map for calculating TDMN is assembled previously based on many experimental works, and stored in the ECU 10. The characteristic map for calculating TDMN is set under the same NE-ACCP condition that is the same as a point in which a map for determining coefficient K described later is assembled. That is, a plurality of level of the engine revolution number NE and the accelerator opening degree ACCP are selected, and the map has two dimensional map data of the TDMN under combined conditions of the selected levels.

Next, under the same condition of the characteristic map for calculating the TDMN, a correction coefficient K adapted to a certain representative operating condition (for example, NE-ACCP condition having a highest actually using frequency), that is, the correction coefficient K depending on a certain representative operating condition with respect to the interval correction amount TDMN is calculated based on a correction map (refer to FIG. 6) formed by measuring a relationship among the engine revolution number NE, the accelerator opening degree ACCP and the combustion chamber pressure (also referred to as combustion chamber pressure or inner cylinder pressure) influencing on the injection mode of pre-injection and actual injection start timing (or injection start delay time) previously by experiment.

Successively, a final interval correction amount TDMN is calculated by multiplying the interval correction amount TDMN by the correction coefficient K (correction amount determining means). Successively, the final injection time period TQM of main injection is calculated by subtracting or adding the final interval correction amount TDMN from or to the basic injection time period TQM of main injection (step S14).

Next, the main injection command value TQMF is calculated by adding a correction item in consideration of the engine cooling water temperature THW and the fuel temperature THF to the final injection time TQM of main injection set by the processing at step S14. The main injection command value is an injection pulse width of main injection applied to the electromagnetic valve 12 of the injector 5 (step S15). Next, the command injection timing T set by the processing at step S5 and the main injection command value TQMF set by the processing at step S15 are set to the output stage of ECU 10 (step S16). Thereafter, the operation returns to initial step S1 and repeats the above-described respective processings.

(Characteristic of Embodiment)

FIG. 7 is a timing chart showing the NE pulse, the INJECTION PULSE and an INJECTION RATE.

As shown by the timing chart of FIG. 7, pre-injection and main injection pulses are outputted during one period of the engine 1 in this order. A number of times of injections is determined by the engine revolution number NE and the target injection amount Q.

Figure 2C:
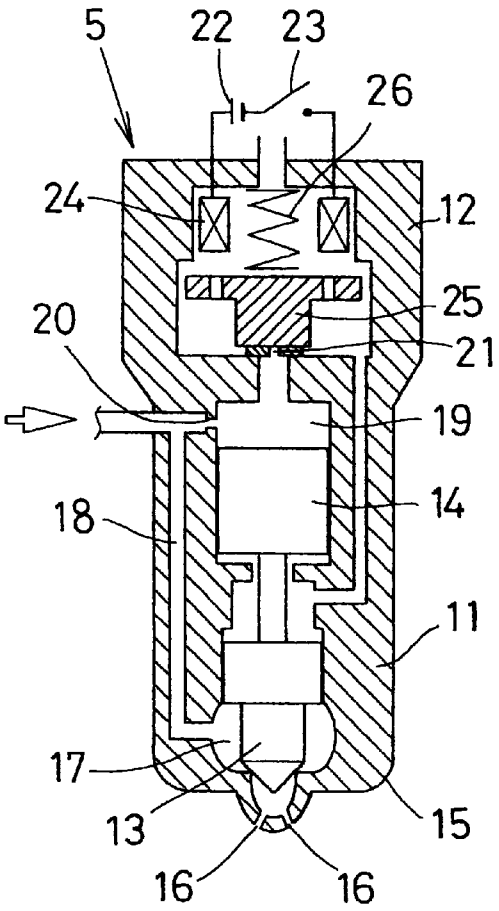
FIG. 2C is a sectional view showing the injector according to the first embodiment of the invention.
Figure 2B:
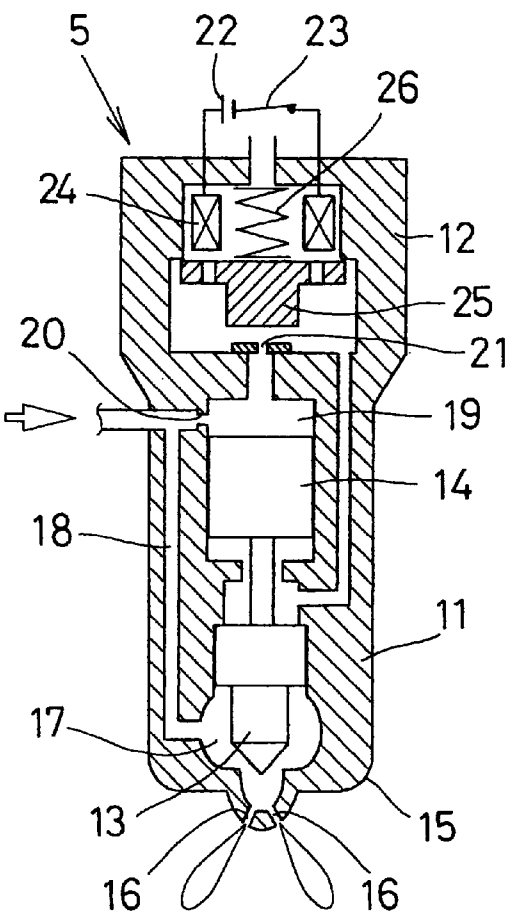
FIG. 2B is a sectional view showing the injector according to the first embodiment of the invention.
Figure 2A:
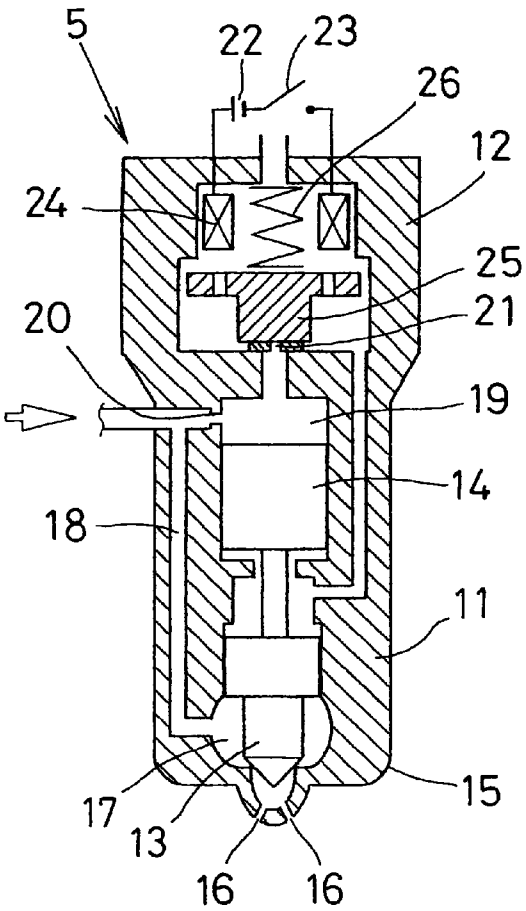
FIG. 2A is a sectional view showing an injector according to the first embodiment of the invention.

FIG. 2A shows a noninjection state of the injector 5. As shown by FIG. 2B, when the normally open type switch 23 of the injector drive circuit is closed, the valve body 25 of the electromagnetic valve 12 is opened. During a time period in which the electromagnetic valve 12 is being opened, fuel in the pressure control chamber 19 is leaked to the leak pipe 36 via the orifice 21 and therefore, the nozzle needle 13 is lifted. Thereby, high pressure fuel accumulated in the common rail 4 is supplied to inject into the combustion chamber of a specific cylinder of the engine 1.

Thereafter, when injection finish timing is reached, the normally open type switch 23 of the injector drive circuit is opened. As shown by FIG. 2C, the valve body 25 of the electromagnetic valve 12 is closed. During a time period in which the electromagnetic valve 12 is being closed, the nozzle needle 13 is seated on the valve seat. Thereby, fuel injection into the combustion chamber of specific cylinder of the engine 1 is finished. Such a fuel injection is repeated as pre-injection and main injection.

In main injection, the nozzle needle 13 is opened after elapse of predetermined injection start delay time TDM from a timing of starting to conduct electricity to the electromagnetic valve 12. However, by rise of the combustion chamber pressure of the engine cylinder by pre-injection, a timing T1 for opening the nozzle needle 13 becomes earlier than expected valve opening timing Ta.

In this case, when a timing of closing the nozzle needle 13 is a previously set valve closing timing Tb, that is, when the main injection time period is the previously set basic injection time, the actual main injection amount is increased more than the main injection amount QM set by the processing at step S4. A total injection amount produced by adding the actual pre-injection amount QP and the main injection amount QM+$\alpha$, is increased more than the target injection amount Q determined by the engine revolution number NE and the accelerator opening degree ACCP.

Figure 8:
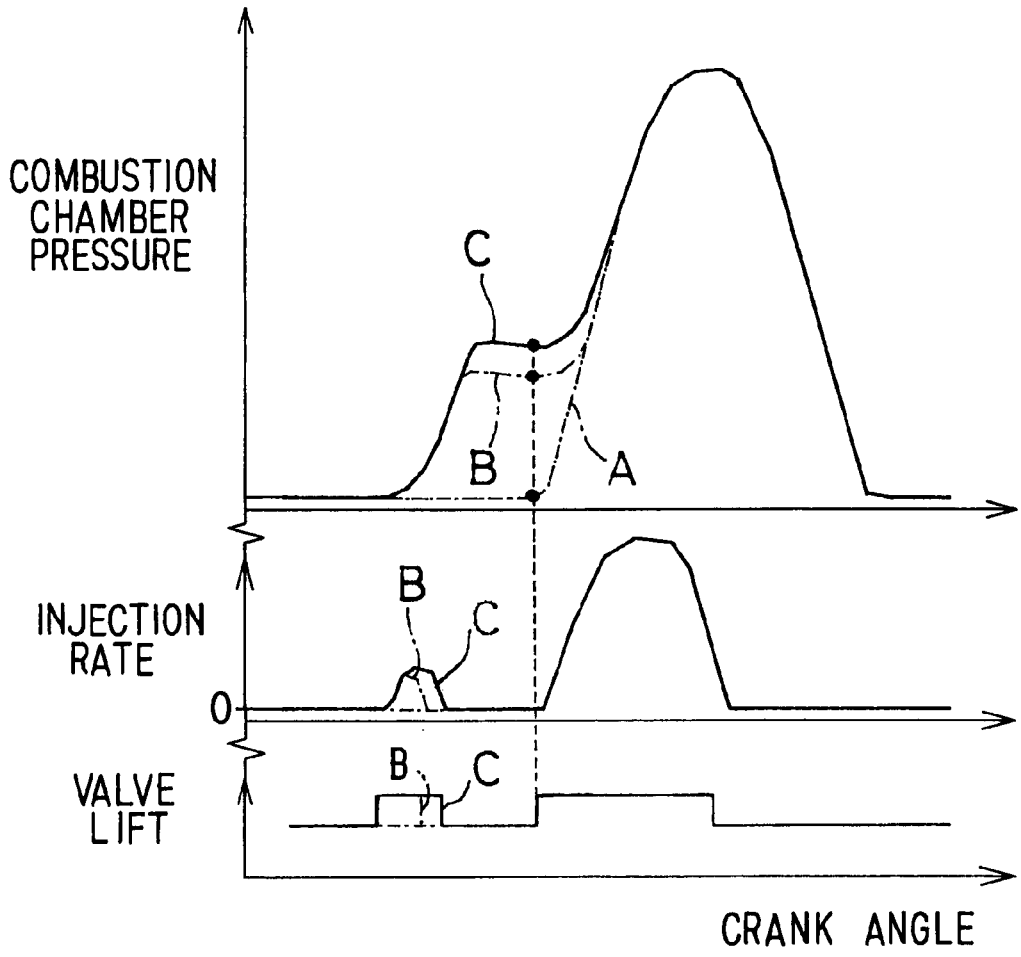
FIG. 8 is a time chart showing combustion chamber pressure according to the first embodiment of the invention.

As shown by FIG. 8, by carrying out pre-injection (one-dotted chain line B and a bold line C of FIG. 8), the combustion chamber pressure rises more than a standard combustion chamber pressure value. A standard value is a combustion chamber pressure value immediately before an injection start timing when pre-injection is not carried out (one-dotted chain line A of FIG. 8). Since the raised combustion chamber pressure maintains a combustion chamber pressure value to a degree of making a valve opening start timing of main injection early even when the valve opening start timing of the main injection is reached, the valve opening start timing of the nozzle needle 13 in main injection is made earlier than an inherent valve opening start timing. That is, in accordance with the injection mode of pre-injection, an influence on the main injection is brought about. Hence, in order to carry out main injection in accordance with a target value, it is preferable to detect or predict the combustion chamber pressure value.

Figure 9:
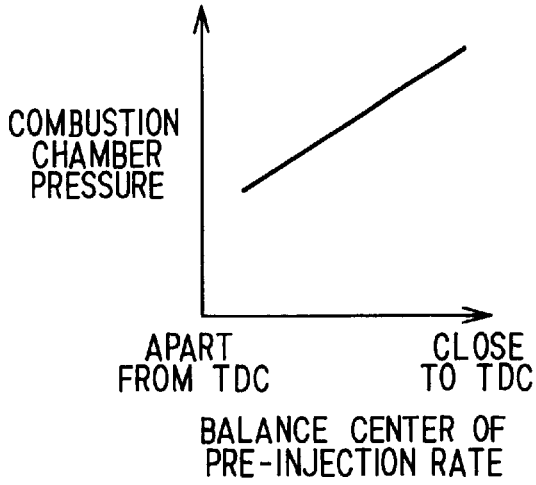
FIG. 9 is a graph showing a relationship between a balance center of a pre-injection rate and the combustion chamber pressure according to the first embodiment of the invention.
Figure 10:
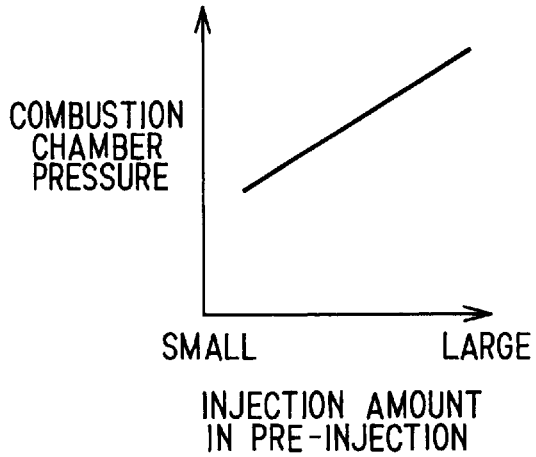
FIG. 10 is a graph showing a relationship between an injection amount of pre-injection and the combustion chamber pressure according to the first embodiment of the invention.
Figure 11:
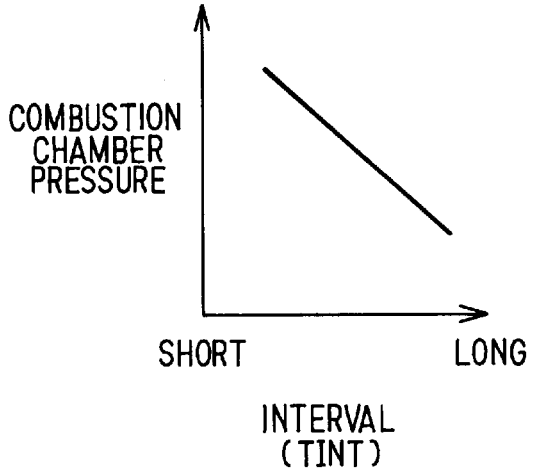
FIG. 11 is a graph showing a relationship between the interval and the combustion chamber pressure according to the first embodiment of the invention.

For example, the combustion chamber pressure is provided with a characteristic as shown by FIG. 9, FIG. 10 and FIG. 11. As the injection mode of pre-injection, a balance center of an injection rate, a pre-injection amount and an interval can be used. There is estimated the combustion chamber pressure value influencing on the valve opening start timing of main injection with an injection balance center position of pre-injection (specifically, injection start timing (relative angle from TDC) of pre-injection, injection finish timing (relative angle from TDC) of pre-injection, the pre-injection amount, the interval between pre-injection and main injection, the engine revolution number, the engine load, the engine cooling water temperature and the fuel temperature as parameters. The estimated value is reflected in the interval correction amount TDMN as a correction coefficient. As a result, accuracy of correcting the injection time period correction amount of main injection can be promoted.

Hence, according to the embodiment, correction data (correction map: refer to FIG. 6) formed by measuring a relationship among the engine revolution number NE, the accelerator opening degree ACCP and the combustion chamber pressure value influencing on the injection mode of pre-injection and the actual injection start timing (or injection start delay time) of main injection previously by experiment is stored previously to the memories. The correction coefficient K with respect to the above-described interval correction amount TDMN is calculated. Further, the final interval correction amount TDMN is calculated by multiplying the interval correction amount TDMN in the case of a reference region by the calculated correction coefficient K.

The final interval correction amount TDMN is calculated by multiplying the interval correction amount TDMN in the reference region by K=1.2 when a ratio of the combustion chamber pressure in a first correction region relative to the combustion chamber pressure in the reference region (K=1.0), is 1.2. Further, the final interval correction amount TDMN is calculated by multiplying the interval correction amount TDMN in the case of the reference region by K=0.8 when a ratio of the combustion chamber pressure at a second correction region relative to the combustion chamber pressure in the reference region (K=1.0), is 0.8. Further, the correction coefficient K may be also calculated by attaching an engine combustion chamber pressure sensor to the respective cylinder of the engine 1 and in accordance with an output signal thereof.

Therefore, according to the common rail fuel injection system of the embodiment, the interval correction amount TDMN can be set to an optimum value not only in a certain representative operating condition (reference region) but also in all of the operating condition of the engine 1. Thereby, the final main injection time TQMF becomes an optimum value in all the operating region of the engine 1. For example, when main injection is started earlier than the injection start timing T, as shown by the timing chart of FIG. 7, the final main injection time TQMF is shortened by an amount of the interval correction amount TDMN also in consideration of the combustion chamber pressure value influencing on the actual injection start timing of main injection.

Conversely, when main injection is started later than the injection start timing T, the final main injection time TQMF is prolonged by an amount of the interval correction amount TDMN also in consideration of the combustion chamber pressure value influencing on the actual injection start timing of main injection. That is, even when the valve opening timing T1 of the nozzle needle 13 becomes earlier than the inherent valve opening timing Ta, the valve closing timing of the nozzle needle 13 can be set to a valve opening timing T2 earlier than a previously set valve closing timing Tb and therefore, the actual main injection amount can be prevented from being deviated from the main injection amount QM previously set by the processing at step S4 by being influenced by the combustion chamber pressure value.

As described above, the main injection time period can be corrected not only in a certain operating condition (reference region) but also all the operating region of the engine 1 and therefore, the total actual injection amount by twice or more of multi-injection can be prevented from being deviated from the previously set target injection amount Q. That is, by reflecting the influence of the combustion chamber pressure caused by pre-injection in the correction amount of the electricity conduction time of the injector drive signal (interval correction amount, correction amount of injection time period of main injection: TDM) for main injection, accuracy of the injection amount of the main injection amount in carrying out multi-injection can be promoted. Further, by reflecting the correction data of the embodiment in the interval correction amount TDMN as a correction coefficient for the combustion chamber pressure value, accuracy of correcting the correction amount of the injection time period of main injection can be promoted.

Although according to the first embodiment, an explanation has been given of an example of applying the invention to the common rail fuel injection system, the invention may be applied to a fuel injection system of a type which is not provided with the accumulator pipe such as common rail and in which high pressure fuel is supplied directly to the injector via a high pressure pipe from the fuel supply pump. Further, although according to the first embodiment, an explanation has been given of an example of using the injector 5 having the two way type electromagnetic valve, an injector having a three way type electromagnetic valve or other type of an injector may be used.

Although according to the first embodiment, fuel pressure in the common rail 4 is detected by directly attaching the fuel pressure sensor 45 to the common rail 4, fuel pressure delivered from the pressurizing chamber of the supply pump 2 may be detected by attaching fuel pressure detecting means to the fuel pipe or the like from the pressurizing chamber of the supply pump 2 to a fuel path in the injector 5.

The invention may be applied to a common rail fuel injection system capable of carrying out three times or more of multi-injection (for example, pilot injection, main injection, after injection), further, may be applied to a common rail fuel injection system capable of carrying out four times or more of multi-injection (for example, pilot injection, pre-injection, main injection, after injection or pilot injection, main injection, after injection, post-injection).

Further, the invention may be applied to a common rail fuel injection system capable of carrying out five times or more of multi-injection (for example, pilot injection, pre-injection, main injection, after injection, post-injection), further, may be applied to a common rail fuel injection system capable of carrying out six times or more of multi-injection.

According to the invention, the correction coefficient K in consideration of the combustion chamber pressure value in accordance with the operating condition of the engine 1 represented by the engine revolution number NE and the accelerator opening degree ACCP is calculated. In place thereof, the correction coefficient K in consideration of the combustion chamber pressure value may be calculated in accordance with the operating state of the engine 1 represented by either one of the engine revolution number NE and the accelerator opening degree ACCP. Further, the correction coefficient K in consideration of the combustion chamber pressure value may be calculated in accordance with the operating condition of the engine 1 represented by the engine revolution number NE and the target injection amount, and represented by the accelerator opening degree ACCP and the target injection amount Q.

According to the invention, the final main injection time period TQMF is corrected in all the operating region by using the two-dimensional map of TINT-Pc for calculating the interval correction amount TDMN and the correction map (refer to FIG. 6) by the combustion chamber pressure value. In place thereof, the correction map may be formed as follows. As in the related art, the interval correction amount TDMN is adapted to the operation condition of the engine 1 having a highest actually using frequency (NE-Q). At this occasion, the parameter used for correction by the operating region (combustion chamber pressure or the like) is determined as a reference value. Further, the parameter used for correction is recorded in all the operating region. Further, the correction map is formed based on the parameter used for correction in all the operating region. Also thereby, the interval in main injection in all the operating region of the engine 1 can be corrected.

Here, according to the embodiment, the target injection amount Q, the command injection timing T and the target common rail pressure Pt are calculated by using the revolution speed sensor 41 and the accelerator opening degree sensor 42 as operating condition detecting means for detecting the operating condition of the engine 1. In place thereof, the target injection amount Q, the command injection time T and the target common rail pressure Pt may be corrected in consideration of detecting signals from the cooling water temperature sensor 43 and the fuel temperature sensor 44 and other sensors (for example, suction temperature sensor, suction pressure sensor, cylinder determining sensor, injection timing sensor) as operating condition detecting means (engine operating condition).

Further, the command injection amount QFIN may be calculated by calculating the basic injection amount Q by the revolution speed sensor 41 and the accelerator opening degree sensor 42 and adding the correction amount of the injection amount in consideration of the engine cooling water temperature THW and the fuel temperature THF on the pump suction side to the basic injection amount Q. Further, the electricity conduction time TQ may be calculated based on a characteristic map or a calculating equation formed by measuring a relationship among the command injection amount QFIN, the actual common rail pressure Pc and the electricity conduction time TQ for the electromagnetic valve 12 of the injector 5 previously by experiment.

Further, the combustion chamber pressure value may be detected in real time by a combustion chamber pressure sensor for detecting the combustion chamber pressure of the engine 1 (for example, vibration sensor for outputting a quasi signal indicating the combustion chamber pressure) and the correction amount of the main injection time period may be corrected to increase, that is, the main injection time period may be corrected to shorten by an amount of increasing the detected combustion chamber pressure value of the engine cylinder more than a standard combustion chamber pressure value (combustion chamber pressure value immediately before injection start timing when pre-injection is not carried out).

Further, the combustion chamber pressure value is changed in accordance with the injection balance center position of pre-injection, the pre-injection amount and the interval as shown by FIG. 9 through FIG. 11. Therefore, the combustion chamber pressure value may be estimated based on any one or more of the injection balance center position, the pre-injection amount and the interval of pre-injection. Further, the correction amount of the main injection time period may be corrected to increase, that is, the main injection time period may be corrected to shorten by an amount of increasing the estimated combustion chamber pressure value more than a standard combustion chamber pressure value.

Second Embodiment

Next, an explanation will be given of a second embodiment to which the invention is applied. The second embodiment is a common rail fuel injection apparatus. The common rail fuel injection apparatus is applied to a diesel engine. In the second embodiment, the constitution shown in FIG. 1 is adopted.

According to the second embodiment, pilot injection and pre-injection are carried out prior to main injection. Pilot injection is carried out prior to pre-injection.

ECU 10 calculates respective injection amounts of multi-injection from the operating condition of the engine 1 and the command injection amount. For example, ECU 10 includes injection amount determining means for calculating a pilot injection amount Qpilot, a pre-injection amount Qpre and a main injection amount Qmain. ECU 10 includes interval determining means for calculating an interval between pilot injection and pre-injection and an interval between pre-injection and main injection. ECU 10 includes pilot injection time period determining means for calculating a pilot basic injection time period Qpilot from a pilot injection amount Qpilot and common rail pressure PC. ECU 10 includes pre basic injection time period determining means for calculating pre basic injection time period TQpre from a pre-injection amount TQpre and the common rail pressure PC. ECU 10 includes main injection time period determining means for calculating main basic injection time period TQmain from the main injection amount Qmain and the common rail pressure PC.

(Control Method of Embodiment)

Figure 12:
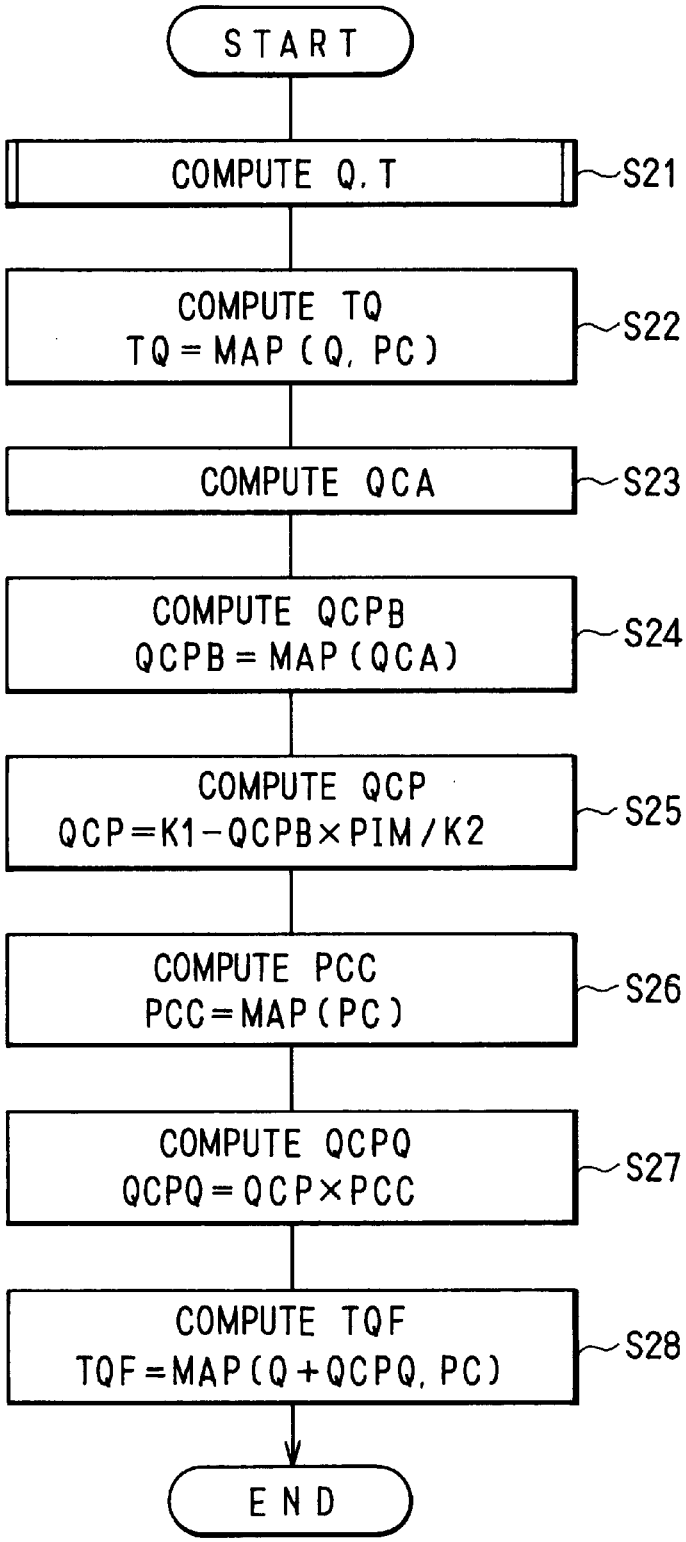
FIG. 12 is a flowchart showing a fuel injection control according to a second embodiment of the invention.

FIG. 12 is a flowchart showing an outline of a method of correcting injection time period of pilot injection, pre-injection and main injection.

A routine of FIG. 12 is repeated at every predetermined timing after the ignition switch, not illustrated, is made ON. For example, a control of an injection amount of the injector 5 of k cylinder may be started immediately after finishing injection of the injector 5 of k cylinder at a preceding cycle, or may be started immediately after injection of a cylinder injected immediately prior to k cylinder at a current cycle (when k cylinder is #1 cylinder, #2 cylinder, when k cylinder is #3 cylinder, #1 cylinder, when k cylinder is #4 cylinder, #3 cylinder and when k cylinder is #2 cylinder, #4 cylinder). Or pilot injection time period of k cylinder may be corrected immediately before pilot injection of k cylinder cycle, further, pre-injection time period of k cylinder may be corrected immediately before pre-injection, further, main injection time period of k cylinder may be corrected immediately before main injection at the current.

First, engine parameters such as a cylinder determining signal pulse and an NE signal pulse are read. Particularly, an engine revolution number NE and an accelerator opening degree ACCP necessary for calculating a command injection amount and an injection timing are read. Next, a cylinder for carrying out an injection amount control is determined from the cylinder determining signal pulse and the NE signal pulse. Successively, the injection amount and the injection timing command value are calculated similarly to the control of the related art (step S21).

That is, the command injection amount is calculated from the engine revolution number NE and the accelerator opening degree ACCP. Next, an injection timing (main injection time), a number of times of injections and an interval are calculated from the engine revolution number NE and the command injection amount. Next, respective fuel injection amounts of multi-injection are calculated. Specifically, the pilot injection amount Qpilot is calculated by a characteristic map or an equation formed by calculating a relationship among the command injection amount, the engine revolution number NE and the pilot injection amount Qpilot previously by experiment (pilot injection amount determining means).

Further, the pre-injection amount Qpre is calculated by using a characteristic map or an equation formed by calculating a relationship among the command injection amount, the engine revolution number NE and the pre-injection amount Qpre previously by experiment (pre-injection amount determining means). Further, the main injection amount Qmain is calculated by subtracting the pilot injection amount Qpilot and the pre-injection amount Qpre from the command injection amount (main injection amount determining means).

Further, a pilot interval between pilot injection and pre-injection is calculated by using a characteristic map or an equation formed by calculating a relationship among the command injection amount, the engine revolution number NE and the pilot interval TINTpilot previously by experiment (pilot interval determining means). Further, a pre interval between pre-injection and main injection is calculated by using a characteristic map or an equation formed by calculating a relationship among the command injection amount, the engine revolution number NE and the pre interval TINTpre previously by experiment (pre interval determining means).

Next, basic injection time period TQ of respective fuel injection of multi-injection is calculated from the respective fuel injection amounts Q of multi-injection and the common rail pressure PC inputted at a preceding cycle by map interpolation (injection time period determining means) (step S22). Specifically, the pilot basic injection time TQpilot, the pre basic injection time period TQpre and the main basic injection time period TQmain are calculated by using characteristic maps formed by calculating relationships among the common rail pressure PC detected by the common rail pressure sensor 45, the fuel injection amounts Q and the basic injection time TQ previously by experiment. Here, the characteristic maps for calculating the basic injection time period TQ of respective fuel injections of multi-injection are maps provided by measuring the respective fuel injection amounts Q of multi-injection, the common rail pressure PC and the injection time TQ by experiment by assuming a case of injecting fuel at a vicinity of TDC of the engine 1.

Next, an injector injection start angle (fuel injection start crank angle) QCA of multi-injection is calculated from the injection timings T calculated at step S21 and the basic injection time period TQ calculated at step S22 (injection start angle calculating means) (step S23). Specifically, a pilot injection start angle QCApilot, a pre injection start angle QCApre and a main injection start angle QCAmain are calculated from the injection timings T, the pilot interval TINTpilot, the pre interval PINTpre calculated at step S21, the pilot basic injection time TQpilot, the pre basic injection time TQpre calculated at step S22.

Figure 13:
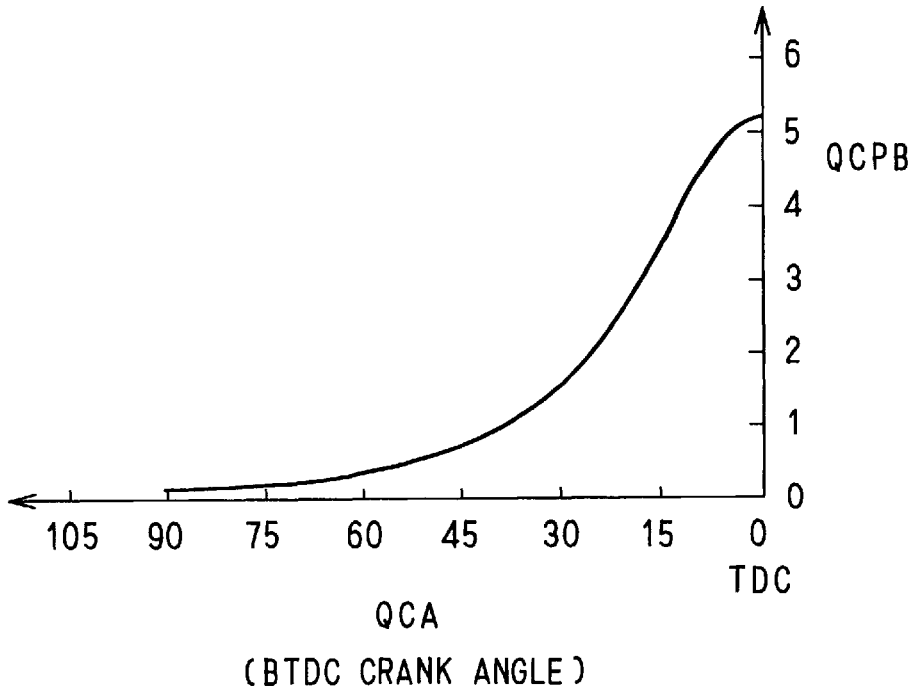
FIG. 13 is a graph showing a relationship between an injection start angle QCA and basic combustion chamber pressure QCPB according to the second embodiment of the invention.

Next, basic combustion chamber pressure QCPB at respective fuel injection start timings of multi-injection is calculated from the respective injection start angles QCA of multi-injection by map interpolation (combustion chamber pressure predicting means) (step S24). That is, the basic combustion chamber pressure QCPB in starting respective fuel injections of multi-injection are calculated by using a characteristic map (refer to FIG. 13) formed by calculating a relationship between the respective injection start angles QCA and the basic combustion chamber pressure QCPB of multi-injection previously by experiment. Specifically, the basic combustion chamber pressure QCPBpilot in starting pilot injection, the basic combustion chamber pressure QCPBpre in starting pre-injection and basic combustion chamber pressure QCPBmain in starting main injection are calculated by using the above-described characteristic map.

Next, combustion chamber pressure change amounts in starting respective fuel injections of multi-injection relative to combustion chamber pressure at a vicinity of TDC of the engine 1 are calculated (combustion chamber pressure change amount calculating means). An injection amount correction amount QCP in accordance with a change in the combustion chamber pressure is calculated from the basic combustion chamber pressure QCPB in starting respective injection of multi-injection and the suction pressure PIM detected by the suction pressure sensor 44 by using Equation (1) shown below (injection amount correction amount calculating means) (step S25). Specifically, a pilot injection amount correction amount QCPpilot, a pre injection amount correction amount QCPpre and a main injection amount correction amount QCPmain in accordance with amounts of changes in the combustion chamber pressure are calculated by using Equation (1)

$$QCP=K1-QCPB\times PIM/K2. \quad (1)$$

Incidentally, notations K1 and K2 designate constants. Notation QCPB designates the basic combustion chamber pressure in starting respective injections of multi-injection. Notation PIM designates suction pressure immediately before respective fuel injections of multi-injection at a current cycle. Notation QCP designates the injection amount correction amount in consideration of an amount of a change between the combustion chamber pressure at a vicinity of TDC of the engine 1 and the combustion chamber pressure in starting respective fuel injections of multi-injection.

Figure 14:
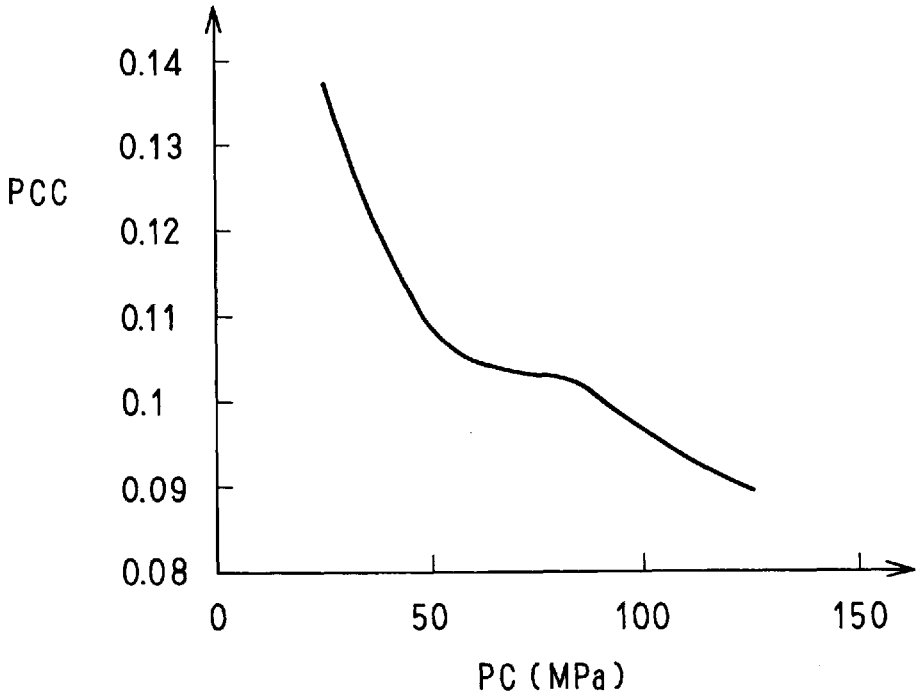
FIG. 14 is a flowchart showing a relationship between common rail pressure PC and a correction coefficient PCC according to the second embodiment of the invention.

Next, by the common rail pressure PC immediately before respective fuel injection of multi-injection a common rail pressure correction coefficient PCC of respective fuel injection of multi-injection is calculated by map interpolation (correction coefficient calculating means) (step S26). That is, the common rail pressure correction coefficient PCC of respective fuel injection of multi-injection is calculated by using a characteristic map (refer to FIG. 14) formed by calculating a relationship between the common rail pressure PC and the common rail pressure correction coefficient PCC immediately before respective fuel injection of multi-injection previously by experiment. This is a fuel pressure correction coefficient in consideration of an amount of a change in the characteristic of the injection amount and the injection time period by the common rail pressure PC immediately before respective fuel injection of multi-injection relative to a characteristic of the injection amount and the injection time period by the common rail pressure PC at a vicinity of TDC of the engine 1. Specifically, a common rail pressure correction coefficient PCCpilot of pilot injection, a common rail pressure correction coefficient PCCpre of pre injection amount and a common rail pressure correction coefficient PCCmain of main injection are calculated by using the characteristic map.

Next, a combustion chamber pressure correction injection amount QCPQ of respective fuel injection of multi-injection is calculated from the injection amount QCP correction amount of respective fuel injection of multi-injection calculated at step S25 and the common rail pressure correction coefficient PCC of respective fuel injection of multi-injection calculated at step S26 by using Equation (2) (correction amount calculating means) (step S27). Specifically, a combustion chamber pressure correction injection amount QCPQpilot of pilot injection, a combustion chamber pressure correction injection amount QCPQpre of pre-injection and a combustion chamber pressure correction injection amount QCPQmain of main injection in correspondence with an amount of a change in a characteristic between the fuel injection amount and the injection time by a change in the combustion chamber pressure of the engine 1 and a change in the common rail pressure are calculated by using Equation (2).

$$QCPQ=QCP\times PCC \quad (2)$$

Incidentally, notation QCP designates the injection amount correction amount of respective fuel injection of multi-injection. Notation PCC designates the common rail pressure correction coefficient of respective fuel injection of multi-injection. Notation QCPQ designates the combustion chamber pressure correction injection amount of respective fuel injection of multi-injection.

Next, final injection time period TQF of respective fuel injection of multi-injection is calculated from the respective fuel injection amount Q of multi-injection, the combustion chamber pressure correction injection amount QCPQ of respective fuel injection of multi-injection and the common rail pressure PC immediately before respective fuel injection of multi-injection by map interpolation (step S28). That is, the final injection time period TQP of respective fuel injection of multi-injection is calculated by using a characteristic map formed by calculating a relationship among the respective fuel injection amount Q of multi-injection, the common rail pressure PC and the final injection time TQF of respective fuel injection of multi-injection previously by experiments. Specifically, final injection time period TQFpilot of pilot injection, final injection time period TQFpre of pre-injection and final injection time period TQFmain of main injection are calculated by using the characteristic map.

Further, although according to the routine of FIG. 12, the basic combustion chamber pressure QCPB in starting main injection and the common rail pressure correction coefficients PCC for pre-injection and main injection are calculated by map interpolation, these can also be calculated by equations. Further, although correction is carried out by using the common rail pressure correction coefficient PCC for the common rail fuel injection system, the embodiment can be used without correction of the common rail pressure also in a fuel injection system which is not provided with a common rail having a distributed type fuel injection pump.

According to the embodiment, combustion chamber pressure when fuel is actually injected is calculated. Further, optimum injection time period in accordance with actual combustion chamber pressure is set. As a result, even in pilot injection, pre-injection and main injection of multi-injection for injecting fuel in a broad range before and after TDC of the engine 1, respective fuel injection amounts (pilot injection amount, pre-injection amount, main injection amount) of multi-injection set in accordance with the operating condition of the engine 1 can correctly be injected.

Further, according to the common rail fuel injection system of the embodiment, by carrying out the control of injecting fuel in three times in one operational cycle of the respective cylinder of the engine 1, that is, multi-injection comprising pilot injection, pre-injection and main injection, rapid rise of initial injection rate can be restrained and therefore, noise of the engine 1 and vibration of engine can be restrained and noise of the engine 1 and the vibration of engine can further be restrained by carrying out pilot injection prior to pre-injection.

Further, when multi-injection comprising pre-injection, main injection and after injection is carried out, by carrying out after injection after main injection, uncombusted gas in main injection can be combusted and therefore, exhaust of smoke can be restrained to thereby improve exhaust gas performance. Further, when multi-injection comprising pilot injection, pre-injection, main injection, after injection and post-injection is carried out, by carrying out post injection after injection, a catalyst can be activated.

The embodiment may be applied to a fuel injection system of a type which is not provided with an accumulating pipe such as common rail for supplying high pressure fuel from a fuel supply pump directly to an injector via a high pressure pipe. In place of the injector 5 having a two way valve type electromagnetic valve, an injector having a three way valve type electromagnetic valve or other type of an injector may be used.

In place of the common rail pressure sensor 45, fuel pressure detecting means may be attached to a fuel pipe between a plunger chamber (pressuring chamber) of the supply pump 2 to a fuel path in the injector 5 to thereby detect pressure of fuel delivered from the pressurizing chamber of the supply pump 2.

In place of the suction control valve 7, a delivery control valve for changing (controlling) a delivery amount of fuel from the pressurizing chamber of the supply pump 2 to the common rail 4 may be provided. Further, although an electromagnetic valve of a normally open type in which a valve opening degree of the suction control valve 7 or the delivery control valve is fully opened when electricity conduction of the electromagnetic valve is stopped, an electromagnetic valve of a normally close type in which the valve opening degree of the suction control valve 7 or the delivery control valve is fully opened when electricity is conducted to the electromagnetic valve may be used.

In place of multi-injection (pilot injection, pre-injection, main injection) of three times of the embodiment, twice of multi-injection (for example, pilot injection, main injection), or three times of multi-injection (for example, pilot injection, main injection, after injection), or four times of multi-injection (for example, pilot injection, pre-injection, main injection, after injection or pilot injection, main injection, after injection, post-injection), or five times of multi-injection (for example, pilot injection, pre-injection, main injection, after injection, post-injection), or six times or more of multi-injection may be carried out.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A fuel injection system for an internal combustion engine for carrying out a multi-injection to inject a fuel into a cylinder of the engine in a plurality of times by calculating an electricity conduction time period of an injector drive signal for an injector from a command injection amount and a fuel pressure set in accordance with an engine operating condition, controlling an opening time period of the injector in accordance with the calculated electricity conduction time period of the injector drive signal and carrying out electricity conduction to the injector by a plurality of times during a compression stroke and an expansion stroke of the engine, the fuel injection system comprising:

(a) correction data storing means for storing a correction data formed by calculating a relationship among a combustion chamber pressure, the engine operating condition and an injection mode of a preceding injection influencing on an actual injection start timing of a succeeding injection carried out successively to the preceding injection carried out precedingly in carrying out the multi-injection previously by an experiment;

(b) operating condition detecting means for detecting the engine operating condition;

(c) injection mode detecting means for detecting or calculating the injection mode of the preceding injection; and (d) electricity conduction time period correcting means for correcting the electricity conduction time period of the injector drive signal for the succeeding injection based on the correction data stored by the correction data storing means, the engine operating condition detected by the operating condition detecting means and the injection mode of the preceding injection.

2. The fuel injection system for an internal combustion engine according to claim 1, wherein the operating condition detecting means is at least one of engine load detecting means for detecting an engine load, revolution speed detecting means for detecting an engine revolution speed, injection pressure detecting means for detecting the fuel pressure and injection amount detecting means for detecting or calculating the command injection amount, the injection mode detecting means is at least one of preceding injection amount detecting means for detecting or calculating an injection amount of the preceding injection, preceding injection time period detecting means for detecting or calculating an injection time period of the preceding injection, interval detecting means for detecting or calculating a noninjection interval between the preceding injection and the succeeding injection, and succeeding injection timing detecting means for detecting or calculating an injection start timing of the succeeding injection, and the correction data storing means stores the correction data formed by calculating a relationship among any one or more of the combustion chamber pressure, the engine load or the engine revolution speed or the fuel pressure or the command injection amount the actual injection start timing of the succeeding injection and any one of or more of the injection amount of the preceding injection or the injection time period of the preceding injection or the noninjection interval between the preceding injection and the succeeding injection or the injection start timing of the succeeding injection previously by an experiment.

3. The fuel injection system for an internal combustion engine according to claim 1, wherein the electricity time period correcting means sets the electricity conduction time period of the drive signal of the injector for the succeeding injection to be shorter in accordance with a degree by which the combustion chamber pressure influencing on the actual injection start timing of the succeeding injection is increased than a standard combustion chamber pressure in a case of not being influenced by the preceding injection.

4. The fuel injection system for an internal combustion engine according to claim 1, wherein the injector comprises a nozzle needle for opening and closing an injection hole for injecting the fuel into the cylinder of the engine, a pressure control chamber for controlling to operate the nozzle needle, needle driving means for driving the nozzle needle in an opening direction by overflowing the fuel at a high pressure supplied to the pressure control chamber to a lower pressure side of a fuel system and needle urging means for urging the needle in a closing direction.

5. The fuel injection system for an internal combustion engine according to claim 1, wherein the succeeding injection is a main injection which can constitute an engine torque at a vicinity of a top dead center and the preceding injection is a small amount of a pilot injection or a pre-injection carried out before carrying out the main injection.

6. The fuel injection system for an internal combustion engine according to claim 1, wherein the preceding injection is a main injection which can constitute an engine torque at a vicinity of a top dead center and the succeeding injection is a small amount of an after injection or a post-injection carried out after carrying out the main injection.

7. Amended A fuel injection system for an internal combustion engine for carrying out a multi-injection to inject a fuel into a cylinder of the engine in a plurality of times by calculating an electricity conduction time period of an injector drive signal for an injector from a command injection amount and a fuel pressure set in accordance with an engine operating condition, controlling an opening time period of the injector in accordance with the calculated electricity conduction time period of the injector drive signal, and carrying out electricity conduction to the injector in a plurality of times during a compression stroke and an expansion stroke of the engine, the fuel injection system comprising:

(a) combustion chamber pressure predicting means for predicting a combustion chamber pressure influencing on an actual injection start timing of a succeeding injection carried out successively to a preceding injection carried out precedingly in carrying out the multi-injection by the engine operating condition and an injection mode of the preceding injection; and (b) conduction time period correcting means for correcting the electricity conduction time period of the injector drive signal for the succeeding injection based on the combustion chamber pressure predicted by the combustion chamber pressure predicting means.

8. A fuel injection system for an internal combustion engine for carrying out a multi-injection to inject a fuel into a cylinder of the engine in a plurality of times by calculating an electricity conduction time period of an injector drive signal for an injector from a command injection amount and a fuel pressure set in accordance with an engine operating condition, controlling an opening time period of the injector in accordance with the calculated electricity conduction time period of the injector drive signal, and carrying out electricity conduction to the injector in a plurality of times during a compression stroke and an expansion stroke of the engine, the fuel injection system comprising:

(a) combustion chamber pressure detecting means for detecting a combustion chamber pressure influencing on an actual injection start timing of a succeeding injection carried out successively to a preceding injection carried out precedingly in the above multi-injection; and (b) conduction time period correcting means for correcting the electricity conduction time period of the injector drive signal for the succeeding injection based on the combustion chamber pressure detected by the combustion chamber pressure predicting means.

9. A fuel injection system comprising:

a fuel supply pump for pressurizing a fuel to constitute a high pressure;

an injector for supplying to inject the fuel at the high pressure delivered from the fuel supply pump to a respective cylinder of an engine; and injection amount controlling means for calculating a command injection amount and an injection timing in accordance with an engine operating condition and driving the injector in accordance with the calculated command injection amount and the calculated injection timing, wherein the fuel injection system is capable of carrying out a multi-injection for injecting the fuel in one cycle of the engine in a plurality of times, and the injection amount controlling means comprises:

injection time period determining means for calculating a basic injection time period of a respective fuel injection of the multi-injection from a map or an equation showing a relationship between a fuel injection amount and an injection time period set by assuming (predicting) fuel injection at a predetermined angle at a vicinity of a top dead center of the engine;

injection start angle calculating means for calculating a respective injection start angle of the multi-injection from the injection timing and the basic injection time period;

combustion chamber pressure calculating means for calculating a combustion chamber pressure when the respective fuel injection of the multi-injection is started by a map or an equation showing a relationship between the injection start angle and the combustion chamber pressure; and correcting means for correcting the basic injection time period of the respective fuel injection of the multi-injection in accordance with an amount of a change between the combustion chamber pressure calculated based on the injection start angle and the assumed combustion chamber pressure assumed in calculating the basic injection time period.

10. The fuel injection system according to claim 9, further comprising:

fuel pressure detecting means for detecting a fuel pressure in correspondence with a fuel injection pressure; and suction pressure detecting means for detecting a suction pressure of air sucked into the cylinder of the engine, wherein the injection amount controlling means comprises:

correction amount calculating means for calculating a correction amount of an injection amount in consideration of the amount of the change in the inner cylinder pressure between the combustion chamber pressure calculated based on the injection start angle and the assumed combustion chamber pressure assumed in calculating the basic injection time period by adding the suction pressure detected by the suction pressure detecting means to a calculated value of the combustion chamber pressure in starting the respective fuel injection of the multi-injection.

11. The fuel injection system according to claim 10, wherein the correction amount calculating means comprises:

correction coefficient calculating means for calculating a fuel pressure correction coefficient from the fuel pressure immediately before the respective fuel injection of the multi-injection detected by the fuel pressure detecting means, wherein an inner cylinder pressure correction injection amount of the respective fuel injection of the multi-injection is constituted by a value produced by multiplying the correction amount of the injection amount by the fuel pressure correction coefficient.

12. The fuel injection apparatus according to claim 11, wherein the injection amount controlling means comprises:

injection amount correcting means for calculating a final correction injection amount of the respective fuel injection of the multi-injection by adding the inner cylinder pressure correction injection amount to the respective fuel injection amount of the multi-injection.

13. The fuel injection apparatus according to claim 11, wherein the injection amount controlling means comprises:

injection time period correcting means for calculating a final injection time period of the respective fuel injection of the multi-injection by adding the fuel pressure immediately before the respective fuel injection of the multi-injection and the inner cylinder pressure correction injection amount to the basic injection time period of the respective fuel injection of the multi-injection.

* * * * *